United States Patent [19]

Yang et al.

[11] Patent Number: 4,638,517

[45] Date of Patent: Jan. 27, 1987

[54] STRUCTURE FOR BED

[75] Inventors: Yan Y. Yang; Chu H. Tsair, both of Taipei, Taiwan

[73] Assignee: Ming Cherng Tsai, Taipei, Taiwan

[21] Appl. No.: 741,797

[22] Filed: Jun. 6, 1985

[51] Int. Cl.[4] ..... A47C 23/06; A47C 27/16

[52] U.S. Cl. ..... 5/236 R; 5/238; 5/191; 5/464; 5/468; 5/438; 5/481

[58] Field of Search ..... 5/236 R, 236 B, 237, 5/238, 438, 191, 286, 448, 464, 108, 109, 481, 502, 468

[56] References Cited

U.S. PATENT DOCUMENTS

| | | | |
|---|---|---|---|
| 212,009 | 2/1979 | Iske | 5/237 |
| 3,082,768 | 3/1963 | Johns | 5/468 |
| 3,176,323 | 4/1965 | Degen | 5/238 |
| 3,601,121 | 8/1971 | Roberts | 128/33 |
| 4,222,134 | 9/1980 | Degen | 5/191 |
| 4,369,535 | 1/1983 | Ekkerink | 5/481 |

*Primary Examiner*—Alexander Grosz

*Attorney, Agent, or Firm*—Lowe, Price, LeBlanc, Becker & Shur

[57] ABSTRACT

An improved bed structure comprising a rectangular main frame including two supporting members forming the opposing lengthwise sides of the frame, a pillow portion disposed between the front ends of the supporting members, an arcuate portion disposed between the middle of the supporting members and secured there with a plurality of fixing seats which are disposed on the supporting members, and an end portion which is disposed between the lower parts of the supporting members. The mattress body consists of a plurality of pads and is disposed on the main frame.

2 Claims, 4 Drawing Figures

STRUCTURE FOR BED

BACKGROUND OF THE INVENTION

This invention relates to an improved structure for bed. Conventional spring mattress beds cannot provide a suitable and comfortable arrangement for the body. Especially, since the stress caused by body weight is not uniformly distributed, the body is prone to injury.

SUMMARY OF THE INVENTION

It is the primary object of the present invention to provide an improved bed structure which comprises a main frame which is furnished with an arcuate portion for the upper body (shoulders and back) and hips and distributes the stress on the human body uniformly.

It is another object of the present invention to provide an improved bed structure which comprises a mattress body disposed on the main frame into which the tea and mint can be inserted to provide an easy and comfortable feeling for the body.

It is still another object of the present invention to provide an improved bed structure which is suitable for the human body.

DETAILED DESCRIPTION OF THE PREFERRED EMBODIMENT

Figure 1:
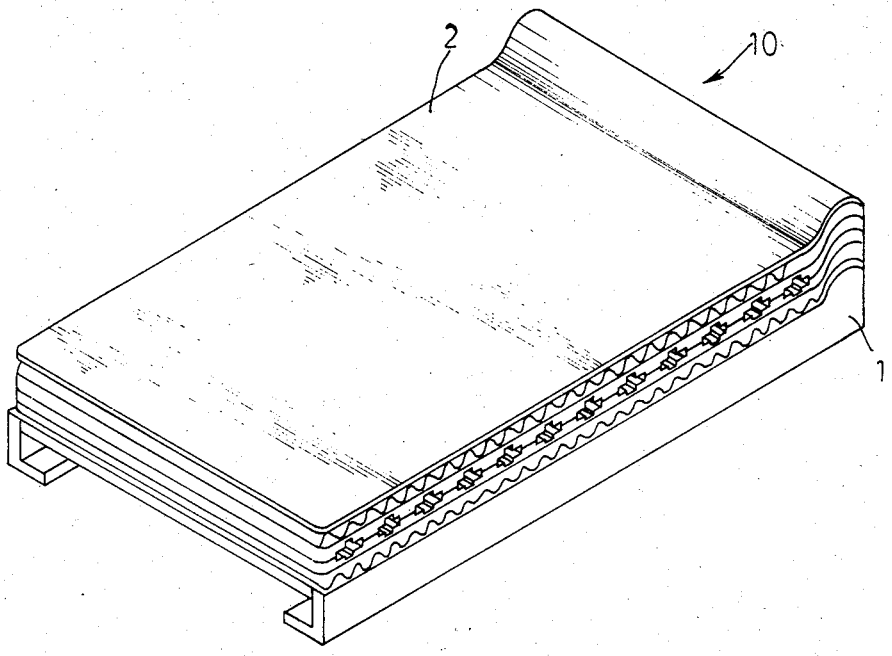
FIG. 1 is a perspective view of a preferred embodiment of the present invention.
Figure 2:
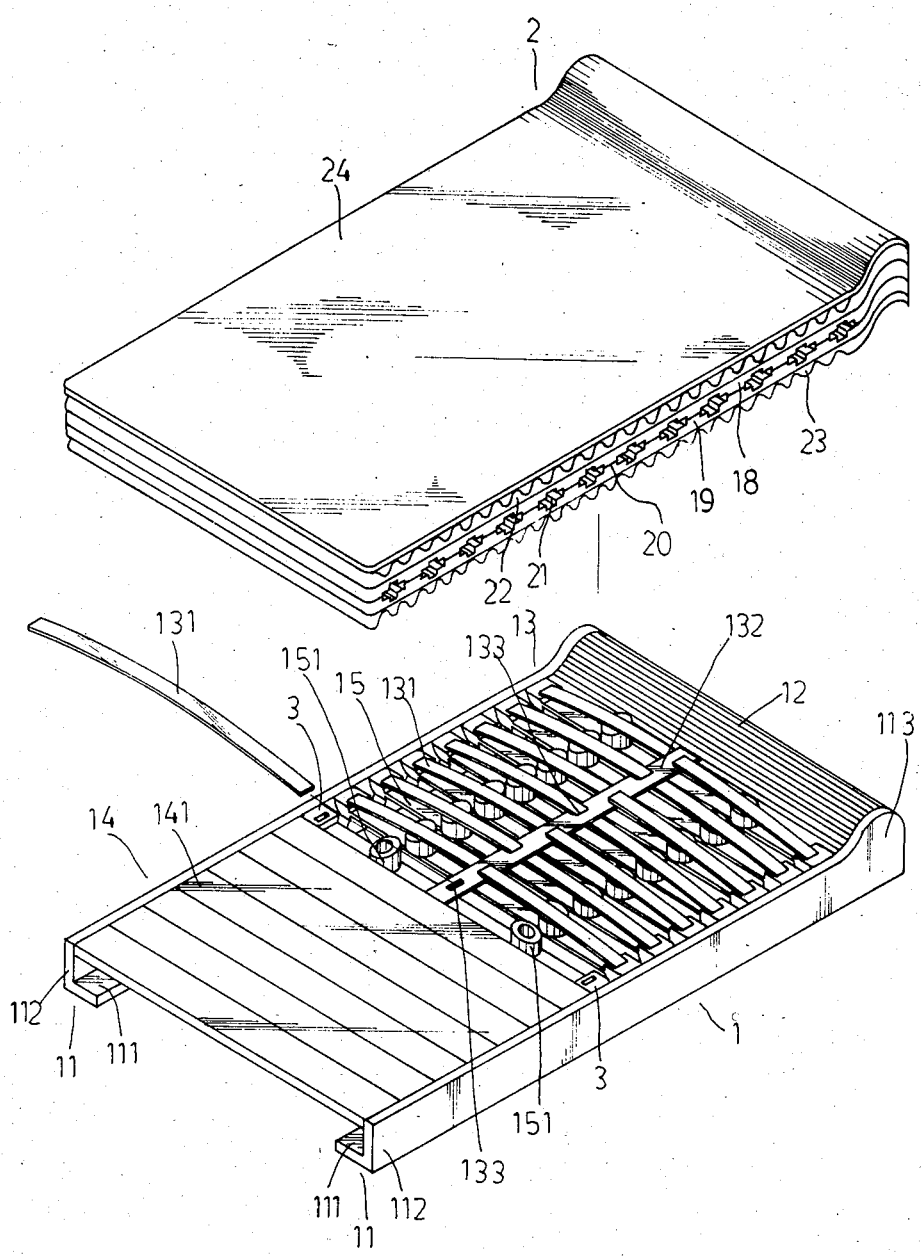
FIG. 2 is a perspective fragmental view of FIG. 1.
Figure 3:
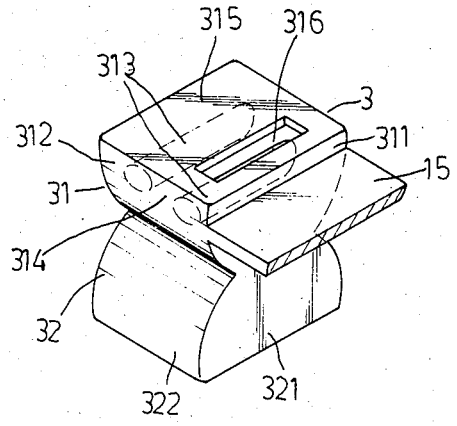
FIG. 3 illustrates a detailed perspective view of the fixing seat with a supporting piece connected thereto as shown in FIG. 2.
Figure 4:
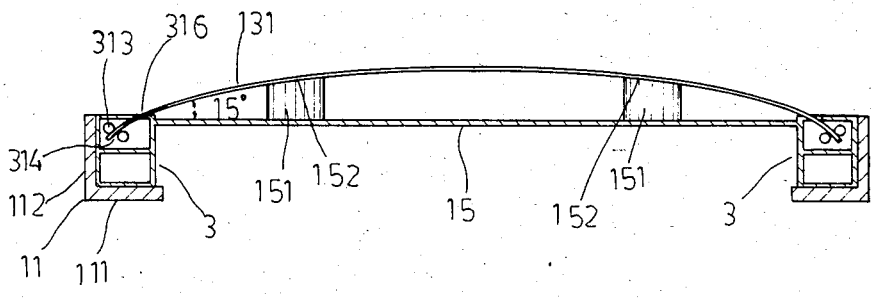
FIG. 4 is a cross-sectional view which illustrates a bamboo piece fixed by a pair of aligned fixing seats.

Referring to the drawings and particularly to FIGS. 1 and 2, an improved bed structure (10) mainly comprises a rectangular main frame (1) and a mattress body (2) corresponding to the main frame (1) and disposed thereon. The main frame (1) is provided at the longitudinal (lengthwise) sides with a pair of parallel supporting members (11), each of which has a bottom wall (111) and a side wall (112) which are perpendicular to each other. Each side wall (112) is furnished with an arcuate end (113). A pillow portion (12), preferably made of bamboo, is disposed between the arcuate ends (113) of the supporting members (11) so as to form a headrest. An end portion (14) consisting of a plurality of bamboo plates (141) is located on the opposite ends of the main frame (1) for the legs and feet. An arcuate portion (13), preferably made of bamboo, is located between the pillow portion (12) and the end portion (14) for the upper body (shoulders and back) and hips. Referring to FIGS. 2 and 4, a plurality of fixing seats (3) are disposed on the bottom walls (111) of the supporting members (11) in such a manner that each of the fixing seats (3) located on one of the supporting members (11) is aligned with its corresponding fixing seat (3) located on the other supporting member (11). In addition, there are a plurality of supporting pieces (15), each of which is connected between each pair of aligned fixing seats (3). Each supporting piece (15) is furnished with a pair of supporting columns (151) each one having a shaved upper portion (152). Referring to FIG. 3, each fixing seat (3), preferably made of elastic materials, consists of a pair of closed upper and lower hollow bodies (31 and 32), wherein the upper body (31) is formed with a pair of opposing flat sides (311) and a pair of opposing arcuate sides (312), being symmetrically shaped. The lower body (32) is also formed with a pair of opposing flat sides (321) and a pair of opposite arcuate sides (322) symmetrically extending downwardly. The interior of the upper body (31) has a pair of pins (313), which form a slit (314) therebetween. The upper end (315) of the upper body (31) has a slot (316) which can be associated with the slit (314) thereon to serve as a fixing means. Referring to FIGS. 2 to 4, the arcuate portion (13) comprises a plurality of arcuate bamboo pieces (131) which are bent concave downwardly.

Each bamboo piece (131), corresponding to each pair of aligned fixing seats (3), is so arranged that the two ends are inserted through the slots (316) and then into the slits (314) of the corresponding fixing seats (3). Finally, the ends of each bamboo piece are clamped between the pins (313). Referring to FIG. 4 it should be noted the angle between the bamboo piece (131) and the supporting piece (15) is preferably about 15°. Also, the underside of the bamboo piece (131) contacts slightly with the shaved portion (152) of the supporting columns (151). Furthermore, a fixing strip (132) (see FIG. 2) is furnished with a plurality of lengthwise slits (133) through which a plurality of corresponding bamboo pieces (131) pass. This arrangement secures the bamboo pieces (131).

Referring to FIG. 4, when the bamboo pieces (131) are pressed downward by body weight, they can be supported by both the supporting columns (151) and the fixing seats (3). Since the fixing seats (3) have an arcuate structure as described hereinabove, the stress thus produced is uniformly distributed. Further, owing to the specified curve of the bamboo pieces (131), the stress caused by body weight can be effectively reduced.

Referring to FIG. 2, the mattress body (2) comprises a pair of sponge pads (18 and 19) facing each other with a sheet of cotton (20) disposed therebetween. Each of the sponge pads (18 or 19) has a plurality of recesses (21). If desired, a plurality of electrically actuated vibrators (not shown) can be disposed within the recesses (21) to serve as a massaging means.

Another pair of wave-like pads (22) (23), preferably made of ethylene-vinyl acetate (EVA) material, are so disposed that one wave-like pad on the top side of the sponge pad (18) and one wave-like pad being on the bottom of the sponge pad (19). Because of their wave-like shape, the EVA pads provide good ventilation.

A top pad (24) is disposed on the upper side of the mattress body (2). The interior of the top pad (24) is filled with tea and mint to provide a comfortable feeling.

Furthermore, a heating pad (cannot be seen in the drawings) can also be inserted into the top pad (24) to serve as a heating apparatus.

We claim:

1. An improved structure for bed comprising:

a rectangular main frame provided at its opposite long sides with a pair of parallel supporting members each of which is formed with a first wall and a second wall perpendicular thereto, each said second wall being furnished with an arcuate end, a pillow portion being disposed on the arcuate ends of the supporting members to receive a human's head, an end portion being located on the opposite ends of the supporting members to receive the human's legs and feet, an arcuate portion being placed on the middle of the supporting members and located between the pillow portion and the end portion thereof to receive a human's shoulders, back and hips, the arcuate portion comprising a plurality of bamboo pieces which are bent downwardly to form a predetermined curve;

a plurality of fixing seats each of which consists of a pair of closed upper and lower hollow bodies wherein the upper body is formed with a pair of opposite flat sides and another pair of opposite arcuate sides symmetrically extending upwardly while, the lower body is formed with a pair of opposite flat sides and another pair of opposite arcuate sides symmetrically extending downwardly, the upper body being provided at its interior with a pair of pins which are parallel to each other and to the flat side thereof and form a slit therebetween, the closed upper end of the upper body being formed with a slot which can be associated with the slit therein to serve as a fixing means, said fixing seats being respectively disposed on the first walls of the supporting members in such a manner that each fixing seat located on one of the supporting members is aligned with its corresponding fixing seat located on the other supporting member thereof, a plurality of supporting pieces each of which is connected between the upper bodies of each pair of aligned fixing seats, a pair of short supporting columns respectively disposed on the upperside of each supporting piece and each supporting column being provided at its upper end with a shaved portion, each bamboo piece of the arcuate portion corresponding to each pair of aligned fixing seats being so arranged that its both ends are respectively inserted through the slots and then into the slits of the fixing seats and finally clamped between the pins therein, when the bamboo pieces fixed in the corresponding fixing seats, the angle between each bamboo piece and its corresponding supporting piece being preferably 15° and the underside of each bamboo piece being contacting slightly with the shaved portions of the supporting columns, a fixing strip furnished with a plurality of slits through which a plurality of corresponding bamboo pieces may pass to fix said bamboo pieces fixedly connected together;

a mattress body comprising a pair of sponge pads which are overlapped with each other and form a plurality of recesses therebetween, a sheet of cotton disposed between the sponge pads, to absorb the moisture therein, a pair of EVA pads, which are wave-like on one surface, respectively disposed on the upperside and the underside of the sponge pads; wherein the EVA pads are formed into wave type for obtaining a better ventilation effect, a top pad disposed on the upperside of the mattress body, wherein the interior of the top pad is filled with tea and mint to provide a comfortable feeling for a human's body.

2. An improved structure for bed, as claimed in claim 1, wherein a heating pad can be received in said top pad to serve as a heating means.

* * * * *